US005459894A

United States Patent [19]

Buonocore

[11] Patent Number: 5,459,894

[45] Date of Patent: Oct. 24, 1995

[54] DOWN FUTON MATTRESS

[75] Inventor: Frederick Buonocore, East Williston, N.Y.

[73] Assignee: Eurasia Feather Co., Inc., Grand Rapids, Mich.

[21] Appl. No.: 111,104

[22] Filed: Aug. 24, 1993

[51] Int. Cl.[6] ..... A47C 27/22

[52] U.S. Cl. ..... 5/481; 5/480; 5/465; 53/524

[58] Field of Search ..... 5/448, 465, 471, 5/480, 481; 53/524

[56] References Cited

U.S. PATENT DOCUMENTS

| | | | |
|---|---|---|---|
| 82,975 | 10/1868 | Morey . | |
| 123,628 | 2/1872 | Haley . | |
| 731,777 | 6/1903 | Hoey . | |
| 1,414,825 | 5/1922 | Meutsch | 53/524 |
| 2,805,428 | 9/1957 | Buchman . | |
| 3,335,435 | 8/1967 | Marsh et al. . | |
| 3,403,414 | 10/1968 | Unger . | |
| 3,543,313 | 12/1970 | Schweigert . | |
| 3,594,833 | 7/1971 | Richter . | |
| 4,064,578 | 12/1977 | Yamada | 5/481 |
| 4,272,874 | 6/1981 | Krein | 53/524 X |
| 4,922,564 | 5/1990 | Thomas | 5/448 X |
| 4,928,337 | 5/1990 | Chauncey | 5/481 X |
| 4,930,173 | 6/1990 | Woller . | |
| 5,265,295 | 11/1993 | Sturgis | 5/448 X |

OTHER PUBLICATIONS

P. 18 of "Down, Inc., 30th Year Anniversary Edition Brochure, 1963–1993," published 1993.

*Primary Examiner*—Michael F. Trettel

*Attorney, Agent, or Firm*—Varnum, Riddering, Schmidt & Howlett

[57] ABSTRACT

A futon mattress is disclosed comprising an outer ticking encasing a foam core disposed between an upper layer and a lower layer of filling. The filling comprises a mixture of down and feathers.

16 Claims, 4 Drawing Sheets

DOWN FUTON MATTRESS

BACKGROUND OF THE INVENTION

1. Field of the Invention

This invention relates to futon mattresses filled with down and feathers.

2. Description of Related Art

A futon is a type of mattress popular in Japan. Typically, a futon comprises a thick cotton batting encased in a fabric ticking. The batting comprises non-woven cotton fibers, which are stuffed into the ticking and tufted thereto. The batting has a limited ability to hold together, and the tufting inhibits shifting of the batting within the outer ticking.

In Japan, futons are typically laid upon the floor of a common living area at night for sleeping, and removed and stored during the day, so that one area of a dwelling can function as a sleeping area at night, and a living area during the day. Due to Japan's high population density, most dwellings are much smaller than their American counterparts, and futons increase the useable space in the dwelling.

Recently, futons have become popular in the United States. Initially, futons were most popular with urban dwellers and college students. Many American cities also experience high population density with resulting small dwelling spaces. College dormitories are notorious for their limited space. Accordingly, futons provide a means by which urban dwellers and college students can extend their useable living space. Also, futons tend to be rather inexpensive compared to more traditional American forms of bedding.

While in Japan futons are typically placed directly upon the floor, in the United States, futons are typically placed upon a futon frame. Many styles of frames exist, but a fairly standard feature is the ability to convert from a bed into a couch. In the bed position, the frame comprises a platform having an upper surface comprising a series of parallel slats which are elevated above the floor surface. In the couch position, a portion of the futon frame rotates into a somewhat vertical orientation form a back of the couch. The remainder of the frame retains its essentially horizontal orientation to form a seat of the couch. Futon frames come in many variations to serve a variety of needs.

The cotton batting in a standard futon tends to mat down over time. Thus, depressions are formed in the mattress in areas receiving constant concentrations of weight. For instance, the area upon which a user's hips rest while sleeping, and the area upon which the user normally sits both become matted down. With some styles of futon frames, this problem is exacerbated as the sitting area and the hip location during sleeping are the same. Proper maintenance of a futon entails frequent rearranging of the futon upon the frame to minimize localized matting down of the cotton batting. This procedure is both relatively ineffective at limiting the matting down process, and difficult due to the great weight of the futon mattress. Typically, a large futon mattress suitable for use by two people at one time weighs in excess of fifty pounds. Higher weights are not uncommon. Some futons incorporate a foam core, surrounded by cotton batting, which alleviates the above problems somewhat.

SUMMARY OF THE INVENTION

The present invention provides a foam cored futon mattress wherein the cotton batting is replaced with a down and feather filling. The resulting mattress is both lightweight and resistant to permanent matting of the fill.

A futon mattress according to the invention comprises a fabric outer ticking enclosing a foam core disposed between an upper fill layer of down and feathers and lower fill layer of down and feathers. Preferably, the filling comprises 10 percent down and 90 percent feathers although the ratio of down to feathers can vary between 1:4 and 1:19. Also, the futon mattress preferably combines with a futon frame. Preferably, the weight of the filling is approximately one-half pound per square foot of futon area.

The ticking can be divided into lateral compartments, each compartment containing a foam core disposed between an upper layer of filling and a lower layer of filling, the fillings comprising a mixture of down and feathers. Preferably, dash-stitches divide the ticking into the lateral compartments. The dash-stitching comprises alternating stitched and unstitched segments.

The foam core can comprise a slab of polyurethane foam approximately ¾"–3½" thick, having a density of approximately one pound per cubic foot. The futon can be divided into lateral compartments, each compartment having a length and a width and containing a single slab of foam. Each slab of foam has a width equal to at least 90% of the width of its respective compartment, and a length equal to at least 90% of the length of its respective compartment.

A method for making a futon according to the invention comprises the following steps: Forming of fabric, a shallow pan shaped first form having a free outer edge. Forming of fabric, a shallow pan shaped second form, of similar dimensions to the first form, also having a free outer edge. Attach a portion of the free outer edge of the first form to a portion of the free outer edge of the second form, thereby forming an outer ticking. Fill the ticking with a first layer of fill comprising feathers and down adjacent the first form, a second layer of fill comprising feathers and down adjacent the second form, and a layer of foam disposed between the first and second layers of fill. Attach the remaining portion of the free outer edge of the first form to the remaining portion of the free outer edge of the second form to enclose the layers of fill and foam within the ticking.

The steps of forming the first and second forms can comprise cutting a piece of fabric into a generally rectangular shape and forming a box stitch at each corner thereof to form the fabric into a rectangular shallow pan shape. The first form and second form preferably have lengths of at least six feet and widths of at least three feet.

BRIEF DESCRIPTION OF THE DRAWINGS

The invention will now be described with reference to the drawings wherein.

DESCRIPTION OF THE PREFERRED EMBODIMENT

Figure 1:
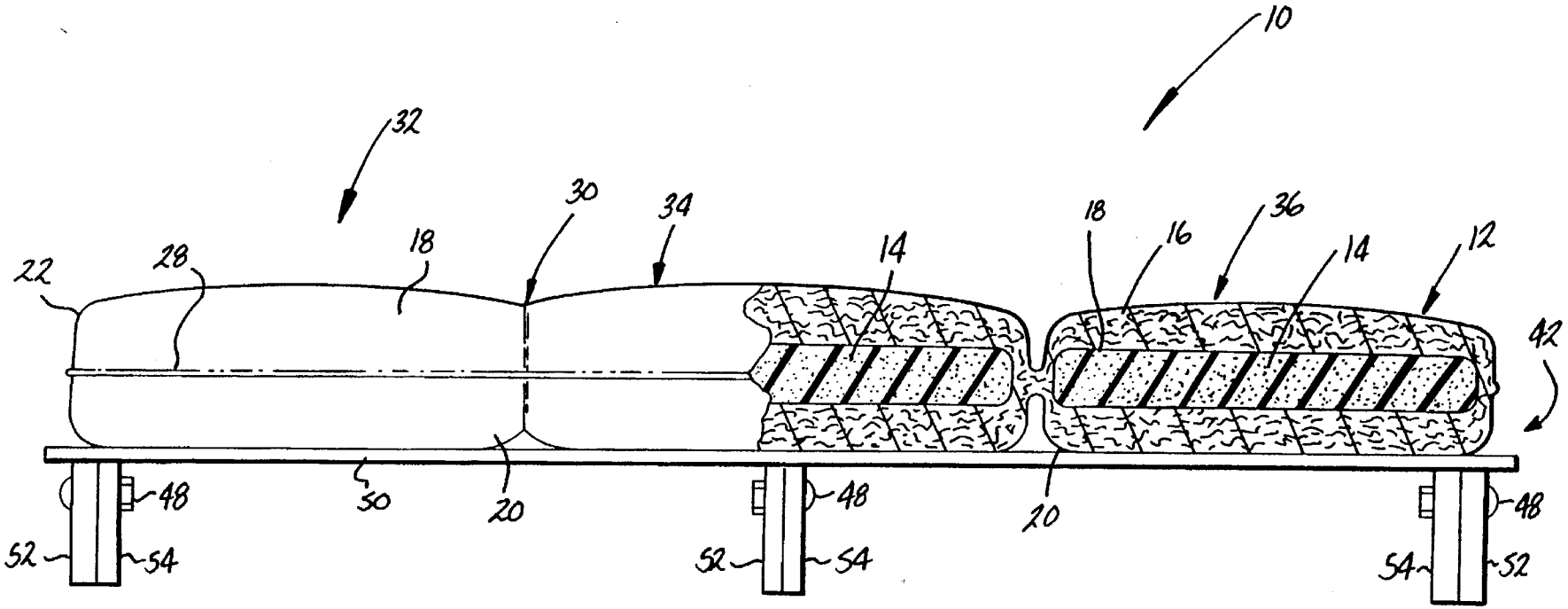
FIG. 1 is a front elevational view, partially in section, of a futon according to the invention shown with a frame in a "sleeping" position.

Referring now to the drawings, and to FIG. 1 in particular, there is shown a futon 10 according to the invention. The futon 10 comprises a fabric ticking 12 encasing three foam cores 14 interposed between fillings 16 of down and feathers. The ticking 12 comprises an upper piece of fabric 18 and a lower piece of fabric 20 sewn together to form an oblong shaped box into which the foam cores 14 and filling 16 are inserted.

Figure 2:
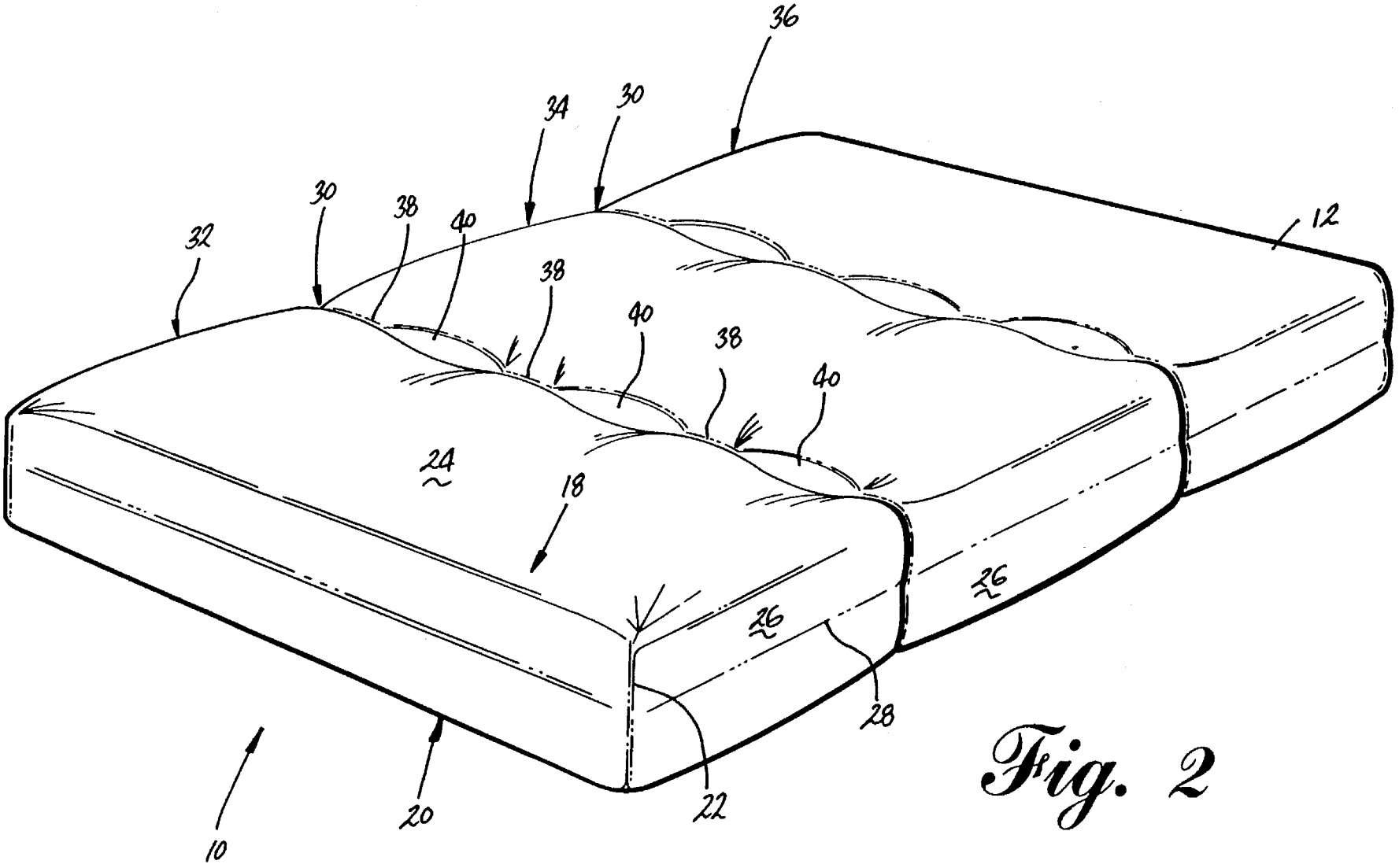
FIG. 2 is a perspective view of the futon of FIG. 1.

Turning to FIG. 2, each of the upper and lower fabric sections 18, 20 comprises a rectangular piece of fabric wherein a standard box stitch 22 is formed at each corner thereof. Thus, each of the upper and lower fabric sections 18, 20 forms a pan shape having a large rectangular face 24 with side panels 26 extending normal to the face 24 along each of its edges. The box stitches 22 join adjacent side panels 26 and extend normal to the face 24. The outer edges of the side panels 26 of the upper fabric section 18 are sewn to the outer edges of the side panels 26 of the lower fabric section 20 to enclose the ticking 12, thereby forming a side seam 28.

Dash stitches 30 divide the futon 10 into a first compartment 32, second compartment 34 and third compartment 36. The three compartments 32, 34, 36 extend laterally across the futon 10 and inhibit uneven distribution of filling 16 (not shown in FIG. 2) within the ticking 12. The dash stitch construction between the lateral compartments 32, 34, 36 comprises a linear stitching pattern wherein the upper fabric section 18 is stitched to the lower fabric section 20 for a short distance 38, and alternatingly left unstitched for a short distance forming a channel 40 between adjacent compartments 32 and 34, and 34 and 36.

The relatively small channel 40 inhibits movement of the filling 16 between compartments 32, 34, 36 during normal use of the futon 10, while nonetheless allowing a user to manually redistribute the filling 16 by forcing filling 16 through the channel 40. Alternatively, a fabric barrier (not shown) can separate the futon 10 into the compartments 32, 34, 36. Of course, the futon 10 can be divided into any number of compartments. However, the three compartments 32, 34, 36 provide separate compartments for a user's head, torso and legs while sleeping.

Returning to FIG. 1, prior to completing the side seam 28, one of the foam cores 14 is inserted into each of the lateral compartments 32, 34 and 36. Each foam core 14 comprises a rectangular slab of polyurethane foam sized to snugly fit within its respective compartment 32, 34 or 36. The foam density is preferably one pound per cubic foot, and each foam core 14 has a rectangular prism shape, preferably three-quarters of an inch to three and one-half inches thick. After the foam cores 14 are thus inserted, the spaces between the foam cores 14 and the upper fabric section 18 are filled with the filling 16, and similarly, the spaces between the foam cores 14 and lower fabric section 20 are filled with filling 16.

The filling preferably comprises ten percent snow white down and ninety percent small white feathers. The weight of fill 16 above each foam core 14 is approximately the same as the weight of fill 16 below each foam core 14. Also, each of the three lateral compartments 32, 34 and 36 contains approximately the same weight of filling 16. Different amounts of filling 16 can be provided for each compartment 32, 34, 36. For instance, more fill 16 can be allocated to the compartments which are designed to be under a user's head and torso, leaving less fill 16 proportionately, under a user's feet. Filling the futon 10 in this manner however, may limit its adaptability to various futon frames as will become more apparent hereinafter.

The completed futon 10 is lightweight and possesses a high degree of comfort. The foam cores 14 provide support, the down portion of the filling 16 provides softness, and the feather portion of the filling 16 provides enhanced lofting ability. When a user lies or sits upon the futon 10, the filling 16 conforms to the user's body, providing a high degree of comfort. The feather component of the filling 16 helps the futon 10 expand to its original shape after the user is no longer sitting or lying thereon.

Figure 3:
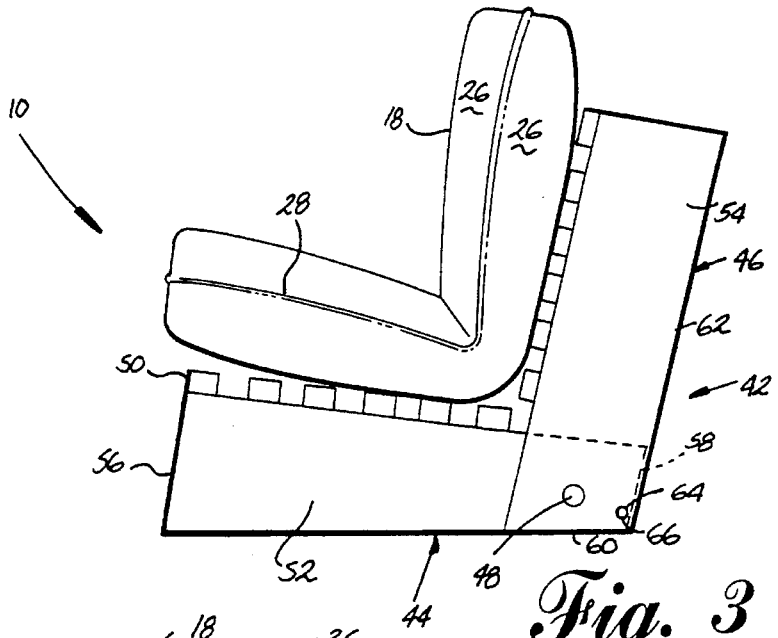
FIG. 3 is a side elevational view of the futon and frame of FIG. 1, shown with the frame in a "sitting" position.

Typically, a futon is used in combination with a frame 42, such as shown in FIG. 3, which illustrates the typical futon frame 42 oriented into a sitting position. The frame 42 comprises a seat portion 44 and a back portion 46 which are rotatable with respect to one another about axially aligned bolts 48. The frame seat 44 comprises a plurality of parallel, spaced apart, slats 50 which are supported upon upper edges of three parallel spaced apart support boards 52, oriented normal to the slats 50. The frame back 46 also comprises a plurality of slats 50 mounted upon support boards 54 normal to the slats 50. A forward end 56 of the seat support boards 52 is wider than a rear end 58 thereof, providing a slightly reclining angle to the frame seat 44. The back support boards 54 are of uniform width. However, an end edge 60 of the back support boards 54 is not normal to side edges 62 of the rear support boards 54.

The bolts 48 penetrate the back support boards 54 adjacent the end edges 60, and the seat support boards 52 adjacent the rearward ends 58. The seat support boards 52 thus rest upon the end edges 60, and the angle between the end edge 60 and side edges 62 determines the angle at which the frame back 46 reclines. A slight angle of recline provides a more comfortable seat when the futon 10 is used in the sitting position. Pins 64 through apertures 66 in the seat support boards 52 and back support boards 54, lock the frame back 46 into an upright position.

Figure 4:
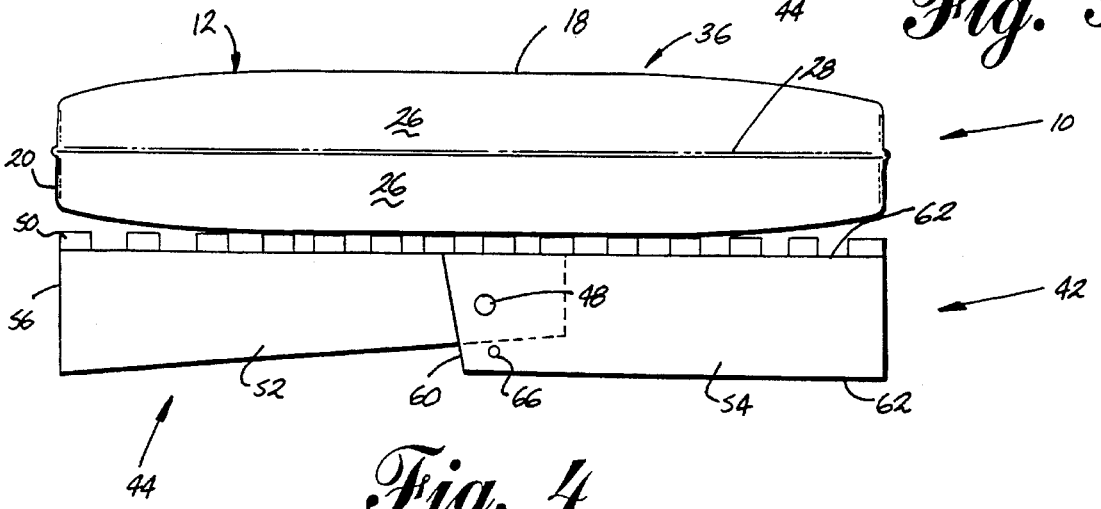
FIG. 4 is a side elevational view of the futon and frame of FIG. 1, shown with the frame in the "sleeping" position.

Turning to FIG. 4, for sleeping, the pins 64 are removed, and the frame back 46 is rotated into a horizontal orientation. The futon 10 in combination with the frame 42 provides a convertible sleeping bed and couch, thereby maximizing use of space in a cramped dwelling. With a standard futon mattress, filled with cotton batting, conversion of the futon frame 42 between sleeping and sitting positions is difficult due to the great weight of the futon. However, the futon 10 according to the invention is light in weight, easing the conversion of the futon frame 42 between sleeping and sitting positions.

Figure 5:
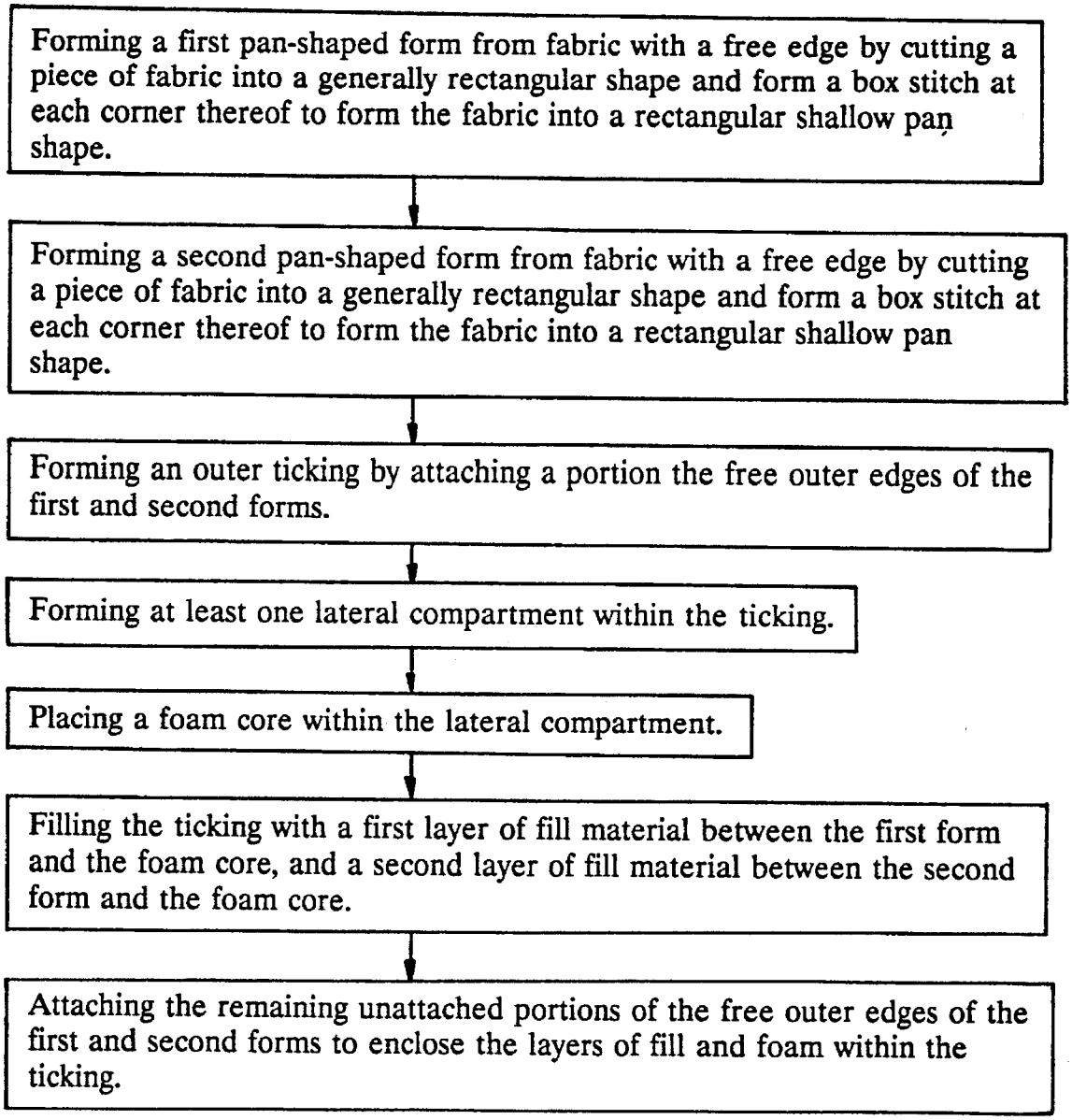
FIG. 5 is a schematic illustration of a method according to the invention.

Preferably, the futon 10, as well as the frame 42, are dimensioned according to standard bedding dimensions. For instance, a "twin" sized futon 10 has the approximate dimensions of 39 inches wide by 75 inches long by 6 inches high, contains a total filling 16 of down and feathers of 12 pounds, and weighs a total of 18¼ pounds. A "full" sized futon 10 is approximately 54 inches wide by 75 inches long by 6 inches high, contains a filling 16 of down and feathers of 15 pounds, and weighs a total of 21¼ pounds. A "queen" sized futon 10 is approximately 60 inches wide by 80 inches long by 6 inches high, contains a total filling 16 of 18 pounds of down and feathers, and weighs a total of 25¼ pounds. The entire futon 10 thus weighs considerably less than its cotton batting filled counterpart. Referring now to FIG. 5, there is shown a schematic illustration of the method disclosed above for making a futon. As shown in FIG. 5, the method comprises forming a first pan-shaped form from fabric with a free edge by cutting a piece of fabric into a generally rectangular shape. Preferably, a box stitch is formed at each corner to form a fabric in the rectangular shallow pan shape. A second pan-shaped form is formed from fabric with a free edge by cutting a piece of fabric into a generally rectangular shape. Preferably, a box stitch is provided at each corner thereof to form the fabric into a rectangular shallow pan shape. Portions of the free outer edges of the first and second pan-shaped forms are attached to form an outer ticking. At least one lateral compartment is formed within the ticking. Preferably, three lateral compartments are formed within the ticking. A foam core is placed within the or each lateral compartment. The ticking is filled with a first layer of fill material between the first form and the foam core. A second layer of fill material is filled between the second form and the foam core. The remaining unattached portions of the free outer edges of the first and second forms are attached to enclose the layers of fill and foam within the ticking.

While particular embodiments of the invention have been shown, it will be understood, of course, that the invention is not limited thereto since modifications can be made by those skilled in the art, particularly in light of the foregoing teachings. Reasonable variation or modification are possible within the foregoing disclosure of the invention without departing from the spirit of the invention. For instance, the futon 10 is suitable for use with any suitable frame design.

The embodiments of the invention in which an exclusive property or privilege is claimed are defined as follows:

1. A method for making a futon comprising the steps of:

forming of fabric, a shallow pan shaped first form having a free outer edge;

forming of fabric, a shallow pan shaped second form, of similar dimensions to the first form, also having a free outer edge;

attaching a portion of the free outer edge of the first form to a portion of the free outer edge of the second form, thereby forming an outer ticking;

filling the ticking with a first layer of fill comprising feathers and down adjacent the first form, a second layer of fill comprising feathers and down adjacent the second form, and a layer of foam disposed between the first and second layers of fill; and attaching the remaining portion of the free outer edge of the first form to the remaining portion of the free outer edge of the second form to enclose the layers of fill and foam within the ticking.

2. A method according to claim 1 wherein the steps of forming the first and second forms comprise cutting a piece of fabric into a generally rectangular shape and forming a box stitch at each corner thereof to form the fabric into a rectangular shallow pan shape.

3. A method according to claim 2 and further comprising the steps of:

forming at least one lateral compartment within the ticking, the compartment being generally rectangular having a length, width and height;

placing a single slab of foam within the lateral compartment, the foam having a length at least 90% of the compartment length and a width at least 90% of the compartment width;

after placing the foam within the compartment, filling a space between the foam and the first form with feathers and down, and filling the space between the foam and the second form with feathers and down.

4. A method according to claim 2 wherein the first form and second form have lengths of at least six feet and widths of at least three feet.

5. A futon mattress comprising:

a fabric outer ticking having an upper fabric layer and a lower fabric layer joined together to form an envelope;

form cores disposed between the upper and lower fabric layers;

a fill material of down and feathers disposed between the fabric outer ticking and the foam cores, the fill material comprising an upper fill layer disposed between the foam cores and the upper fabric layer and a lower fill layer disposed between the foam cores and the lower fabric layer; and connecting members alternatively connecting portions of the upper and lower fabric layers to divide the futon mattress into compartments for receiving the foam cores and to form at least one channel connecting the compartments, the at least one channel being sized to inhibit the movement of fill material between the compartments during normal use and permitting the manual redistribution of the fill material.

6. A futon mattress according to claim 5 wherein the filling comprises 10 percent down and 90 percent feathers.

7. A futon mattress according to claim 5 in combination with a futon frame.

8. A futon mattress according to claim 5 wherein the connecting members divide the ticking into lateral compartments, each compartment containing a foam core disposed between the upper filling layer and the lower filling layer, and the fillings comprising a mixture of down and feathers.

9. A futon mattress according to claim 8 wherein dash-stitches divide the ticking into the lateral compartments, the dash-stitching comprises alternating stitched and unstitched segments.

10. A futon mattress according to claim 5 further comprising the futon being divided into three lateral compartments.

11. A futon mattress according to claim 5 wherein the ratio of feathers to down is between 19:1 and 4:1.

12. A futon mattress according to claim 11 wherein the futon has a length and a width, the futon further comprising a futon area comprising the length multiplied by the width and wherein the weight of the filling is approximately one-half pound per square foot of futon area.

13. A futon mattress according to claim 5 wherein the foam cores are slabs of polyurethane foam with approximately ¾" to 3½" thick and having a density of approximately one pound per cubic foot.

14. A futon mattress according to claim 13 wherein the futon is divided into lateral compartments, each compartment having a length and a width and containing a single slab of foam, each slab of foam having a width equal to at least 90% of the width of its respective compartment, and a length equal to at least 90% of the length of its respective compartment.

15. A futon mattress according to claim 13 wherein the futon contains at least one inner compartment having a length and a width and containing a single slab of foam, the slab of foam having a width equal to at least 90% of the width of the compartment, and a length equal to at least 90% of the length of the compartment.

16. A futon mattress comprising:

a fabric outer ticking enclosing a foam core disposed between an upper fill layer of down and feathers and lower fill layer of down and feathers, and dash-stitches of alternating stitched and unstitched segments dividing the ticking into lateral compartments, each compartment containing a foam core disposed between the upper fill layer and the lower fill layer.

* * * * *